US009312058B2

(12) United States Patent
Michaelsen et al.

(10) Patent No.: US 9,312,058 B2
(45) Date of Patent: Apr. 12, 2016

(54) ELECTROMAGNETIC LINEAR ACTUATOR

(75) Inventors: Rainer Michaelsen, Berlin (DE); Arno Mecklenburg, Berlin (DE); Rainer Schneider, Berlin (DE)

(73) Assignee: MSM Krystall GBR, Berlin (DE)

( * ) Notice: Subject to any disclaimer, the term of this patent is extended or adjusted under 35 U.S.C. 154(b) by 0 days.

(21) Appl. No.: 13/879,756

(22) PCT Filed: Oct. 6, 2011

(86) PCT No.: PCT/DE2011/075245

§ 371 (c)(1),
(2), (4) Date: Apr. 16, 2013

(87) PCT Pub. No.: WO2012/079572

PCT Pub. Date: Jun. 21, 2012

(65) Prior Publication Data

US 2013/0200966 A1 Aug. 8, 2013

(30) Foreign Application Priority Data

| | | |
|---|---|---|
| Oct. 16, 2010 | (DE) | 10 2010 048 447 |
| Dec. 30, 2010 | (DE) | 10 2010 061 641 |
| Jul. 28, 2011 | (DE) | 10 2011 080 065 |

(51) Int. Cl.

| | |
|---|---|
| ***H01F 7/18*** | (2006.01) |
| ***H01F 7/06*** | (2006.01) |
| ***H01F 7/16*** | (2006.01) |
| *H01F 7/122* | (2006.01) |
| *H01F 7/123* | (2006.01) |
| *H01H 3/30* | (2006.01) |
| *H01H 33/38* | (2006.01) |
| *H01H 33/666* | (2006.01) |

(52) U.S. Cl.

CPC ..... *H01F 7/1805* (2013.01); *H01F 7/066* (2013.01); *H01F 7/1607* (2013.01); *H01F 7/122* (2013.01); *H01F 7/123* (2013.01); *H01F 7/1615* (2013.01); *H01H 3/3005* (2013.01); *H01H 33/38* (2013.01); *H01H 33/6662* (2013.01)

(58) Field of Classification Search

CPC ..... H01F 7/066; H01F 7/1607; H01F 7/1805
See application file for complete search history.

(56) References Cited

U.S. PATENT DOCUMENTS

| | | | |
|---|---|---|---|
| 4,236,130 | A | 11/1980 | Hubert |
| 4,808,955 | A | 2/1989 | Godkin et al. |

(Continued)

FOREIGN PATENT DOCUMENTS

| | | | |
|---|---|---|---|
| DE | 1163450 | B | 2/1964 |
| DE | 10360713 | A1 | 7/2005 |

(Continued)

*Primary Examiner* — Ramon M Barrera
(74) *Attorney, Agent, or Firm* — Laurence A. Greenberg; Werner H. Stemer; Ralph E. Locher

(57) ABSTRACT

An electromagnetic linear actuator has a frame (stator) and an armature each at least partially formed of soft magnetic material. The armature can be moved relative to the frame along a longitudinal axis, they form a gap therebetween in an open position and lie against each other in a closed position with the gap closed. A first armature coil is connected to the armature so that a force acting on the first armature coil is transferred to the armature. An excitation magnetic field is generated and guided at least partially by the frame and the armature and acts with a force on the first armature coil when current flows through the first armature coil, to close the gap. The frame, the armature, and the excitation magnetic field are configured so that a retaining force takes effect when the gap between the frame and the armature is closed.

12 Claims, 9 Drawing Sheets

(56) References Cited

U.S. PATENT DOCUMENTS

| | | | | |
|---|---|---|---|---|
| 6,373,675 | B1 | 4/2002 | Yamazaki et al. | |
| 6,611,413 | B2 | 8/2003 | Takeuchi et al. | |
| 2008/0272659 | A1 * | 11/2008 | Jeong et al. | 310/28 |

FOREIGN PATENT DOCUMENTS

| | | | | | |
|---|---|---|---|---|---|
| EP | 1655755 | A1 | | 5/2006 | |
| FR | 2913142 | A1 | * | 8/2008 | H01H 53/015 |
| GB | 1322677 | A | * | 7/1973 | H01F 7/08 |
| JP | H08124762 | A | | 5/1996 | |
| JP | 2000268683 | A | | 9/2000 | |
| JP | 2000331576 | A | | 11/2000 | |
| JP | 2001289525 | A | | 10/2001 | |
| JP | 2002124158 | A | | 4/2002 | |
| JP | 2003068179 | A | | 3/2003 | |
| JP | 2005116554 | A | | 4/2005 | |
| JP | 2010519776 | A | | 6/2010 | |

* cited by examiner

ELECTROMAGNETIC LINEAR ACTUATOR

TECHNICAL FIELD

The invention relates to the field of electromagnetic linear actuators for tensioning and holding springs in spring-operated actuators.

BACKGROUND

The mode of operation of electromagnetic actuators is based on the effect of the Lorentz force and the reluctance force (also called Maxwell's force).

Actuators, which are structured like a lifting magnet, can be utilized for the actuation of machine levers, valves, gate valves, switches, etc. Lifting magnets are electromagnets comprising armature, stator and coil/s. Their structure is simple and robust and they can generate great retaining powers with little power consumption. When lifting large loads, their electrical efficiency is small however, due to the large air gap associated with the heavy lift. In the most simple approximation (no stray field, no saturation), the current required for producing a specific force is proportional to the length of the air gap, and the power loss increases quadratically with the current. The actual ratios are even less favorable. Because of the high power loss, long-stroke lifting magnets can normally produce even only small initial forces (compared to the retaining force), if the electrical efficiency for the application is insignificant. The limit is given by the current rating. Lifting magnets are described as being "long-stroke," for example, if the maximum lift h of the armature (relative to the stator) is in the order of magnitude h=sqrt(A), where A stands for the cross-sectional area of the armature. The quoted definition must only be understood as being a guide value, however. Generally speaking, to realize an approximate constant actuator force across the entire regulating distance is disproportionately more difficult for larger regulating distances than for smaller ones. The high retaining force is effective only if the air gap is almost zero.

By a suitable geometric design of armature and frame, the path-way performance curve of a lifting magnet can be influenced such (this is described as performance curve impact) that the reluctance force acting on the armature becomes almost independent of the path. Such types of actuators are described as "proportional magnets." When the magnetic force of the armature acts against the restoring force of a spring, the position of the armature can be almost proportional to the armature current, if it is suitably configured. But proportional magnets supply only relatively small forces for long lifts. Moreover, in the attracted condition, proportional magnets can produce only comparatively small retaining forces (compared with lifting magnets without performance curve impact).

Another type of electromagnetic linear actuators are structured similar to a plunger coil, and are also described as electrodynamic actuators. When compared to lifting magnets, plunger coils are more delicate and more complex structural designs. Although suitably designed plunger coils are capable of producing almost uniformly large (Lorentz) forces, these must be absorbed from the free-standing and comparatively filigree coil, however. The cooling of plunger coils can also be technically challenging, since the coil must be suspended so that it can move and should be as light as possible in order to achieve high dynamics. (To mention an example, just think of an electrodynamic loudspeaker). For this reason, it can frequently not be firmly attached to a (solid) heatsink. Contrary to lifting magnets, plunger coils are moreover not capable of generating (retaining) forces using only low-power. They are not really suitable for applications in which it is necessary to maintain a large (retaining) force, using power consumption that is preferably as low as possible.

The object of the invention therefore consists in finding an electrical linear drive capable of producing retaining forces with a similar power like a lifting magnet (without impacting the performance curve), but which is also capable of producing a force in the order of magnitude of the retaining force with long lifts across the entire regulating distance.

SUMMARY

The object mentioned above is accomplished by an electromagnetic linear actuator as claimed. Different exemplary embodiments of the present invention are the subject of the dependent claims.

The following describes an electromagnetic linear actuator. According to one example of the invention, the linear actuator comprises a frame (stator), which is at least partially made of soft magnetic material, and an armature, which is at least partially made of soft magnetic material and which is supported on the frame in such a way that the armature can be moved relative to the frame along a longitudinal axis. The armature and the frame are designed in such a way that there is a gap between the armature and the frame along the longitudinal axis in an open position and that the armature and the frame lie against each other in a closed position so that the gap is closed. A first armature coil is connected to the armature in such a way that a force acting on the first armature coil can be transmitted to the armature. The linear actuator further comprises means for generating an excitation magnetic field, which is guided at least partially by the frame and the armature and is aligned in such a way that a force acts on the first armature coil when current flows through the first armature coil, and said force is transmitted to the armature in order to close the gap. The frame, the armature, and the excitation magnetic field are designed in such a way that a retaining force takes effect when the gap between the frame and the armature is closed.

When compared to a normal electromagnet (lifting magnet without impacting the performance curve) linear actuators pursuant to the present invention offer the advantage of being able to produce a force in the order of magnitude of the retaining force across the entire regulating distance even with long lifts. Pursuant to the example mentioned above, this can be achieved in that one or multiple coil/s wound onto the armature transmit force to the armature in addition to the reluctance force acting on the armature, they also push it "as it were," when the reluctance force of the armature is still low because of the wide open air gap.

Pursuant to an example of the invention, armature and frame together with the gap (as a so-called air gap) form a magnetic circuit, in which the excitation magnetic field is carried. For this purpose, the first armature coil can itself serve as a means for producing an excitation magnetic field, wherein the armature coil is arranged on the armature such that it lies at least partially next to the air gap. In this context, the armature coil can be arranged on the armature, and frame and armature can be designed such that in the opened position of the armature, the excitation magnetic field concentrates itself in a radial direction (transverse to the longitudinal axis) and permeates the armature coil radially.

Pursuant to a further example of the invention, the means for creating the excitation field next to the first armature coil comprise an excitation coil which is assigned to said first armature coil, and which is mechanically connected with the frame, wherein the first armature coil and the associated excitation coil, when current flows through them, generate magnetic fields which are reciprocally opposite. At least in the opened position, a super imposition of these magnetic fields results in a radial (transverse to the longitudinal direction) magnetic flux (excitation field), which can interact with the first armature coil. In the open position, the first armature coil and the excitation coil are assigned so that it is arranged adjacently such that when current flows through the coils, the excitation field interacts with the first armature coil such that a force acts on the first armature coil in the longitudinal direction which closes the gap.

The excitation coil/s arranged on the frame can also be replaced by permanent magnets. Furthermore, multiple pairs (armature coil and the associated excitation coil) can be accommodated within one actuator, similarly to a mechanical series connection, for example. An armature coil can be provided in addition or alternatively, which generates its excitation field itself, as mentioned above. Finally, a retaining coil can be arranged on the frame, which creates a retaining force when the gap is closed. This retaining coil can also be replaced by permanent magnets. In the following, sometimes synonymously, "holding" and "draw in" coils are mentioned. This always refers to coils which are used for the purpose of exerting a reluctance force onto a soft magnetic movable component of the drive (normally the armature). The term "draw-in coil" illustrates this in so far as reluctance forces always act in attracting soft magnetic components. The term retaining coil emphasizes that with suitable dimensioning, a draw-in coil is able to retain the actuator in its position against a restoring force. Within the meaning of this invention, all retaining coils are draw-in coils.

Since the force of the actuator can lie within the same order of magnitude of the retaining force, the actuator is particularly well-suited for the tensioning of springs. The spring/s can then be held in the tensioned state by means of a holding current that is only very small (when using permanent magnets), or be retained tensioned even when they are de-energized.

BRIEF DESCRIPTION OF THE DRAWING

The following figures in the further description are intended in helping to understand the invention better. Further details, variants and further developments of the inventive idea are discussed with reference to the Figures, which relate to a special selected example. The elements in the Figures are not necessarily to be understood as being limiting but are rather intended to illustrate the principle of the invention.

DETAILED DESCRIPTION

Figure 1:
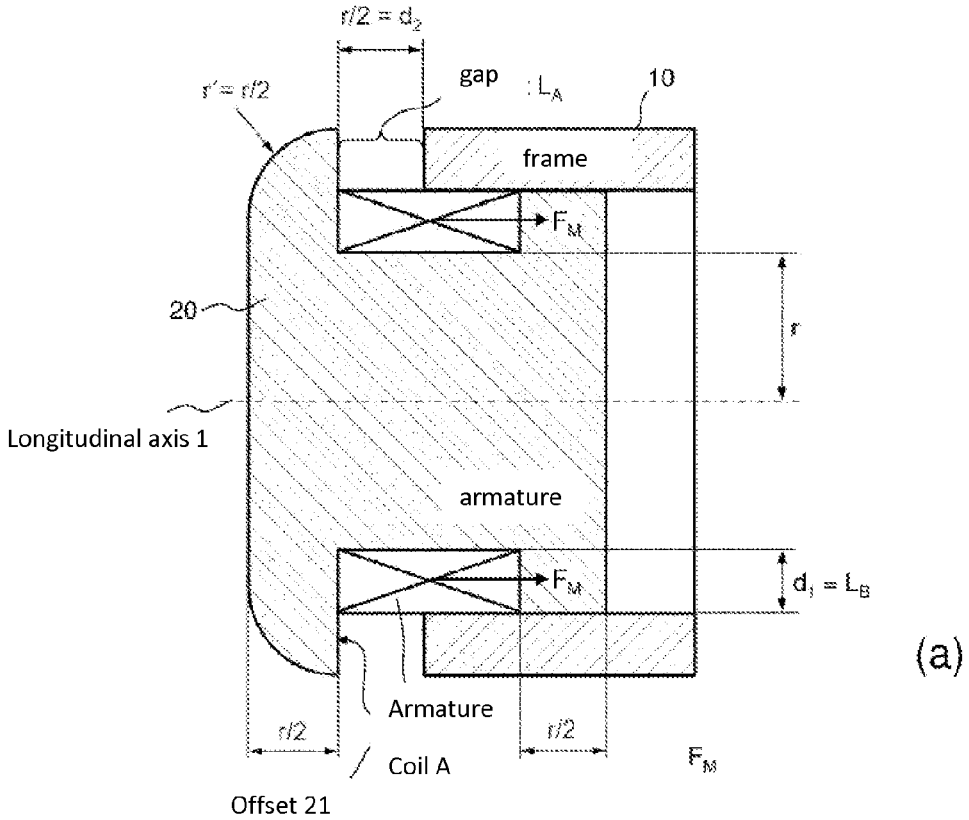
FIG. 1 shows an electromagnetic linear actuator pursuant to an example of the invention in an opened end position (a) and in a closed end position (b). In the opened end position (a), that is at the start of the lift, the magnetic circuit is predominantly closed above the radial air gap $L_B$ (shunt), as a result of which the energized coil that is housed in air gap $L_B$ senses a force which it transmits to the armature: The coil pushes the armature in direction of the closed end position (b). But as a result of the armature movement, the axial air gap $L_A$ reduces, as a result of which its reluctance decreases and the magnetic flow through $L_A$ increases. In the closed end position (b), that is during the disappearing axial air gap $L_A \ll L_B$, the arrangement ultimately works like a traditional lifting magnet. It is naturally also possible that the "armature" can be held in place instead of the "stator;" in this case, stator and armature exchange their roles, and instead of the wound armature, "only iron" is moved, which is easier in many cases. What is decisive for the efficiency of the drive is that the air gap $L_B$ is sufficiently small; it must be particularly small in relation to the fully opened air gap $L_A$.
Figure 1:
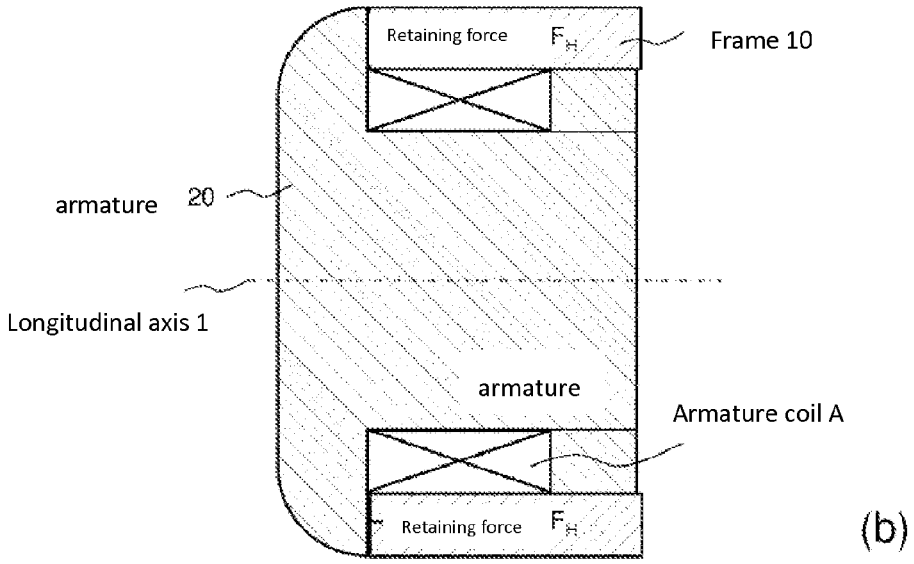

FIG. 1 represents a simple example of a linear actuator according to the invention (FIG. 1*a*: open position, FIG. 1 *b*: closed position). The arrangement illustrated in FIG. 1 is axisymmetrical (longitudinal axis 1 as the axis of symmetry). It is however not mandatory that the actuator be designed axisymmetrically.

Pursuant to the example from FIG. 1, the linear actuator comprises a frame 10 (hereinafter also termed "stator") as well as an armature 20. Both armature 20 as well as stator 10 consist of a soft magnetic material at least partially, in order to be able to conduct magnetic fluxes. The armature 20 is supported on the stator 10 such that the armature 20 can be moved along the longitudinal axis 1 relative to the stator 10. Armature 20 and stator 10 are moreover formed such that along the longitudinal axis 1 between armature 20 and stator 10 a gap $L_A$ exists in an open position between armature 20 and stator 10 and that the armature 20 and stator 10 are lying next to each other in a closed position, so that the gap $L_A$ is closed. A first armature coil A is connected with the armature 20. The connection between the armature coil A and the armature 20 is such that the force acting on the first armature coil A can be transferred to the armature 20. A force acting between a magnetic field and a coil current which acts on the armature coil A because of interaction will consequently also act on the armature 20 itself. The linear actuator according to the example from FIG. 1, ultimately comprises means for generating an excitation magnetic field, which is guided at least partially through the frame and the armature and is directed in such a way that a force $F_M$ acts on the first armature coil 20 when current flows through it, which is transmitted to the armature 20 in order to close the gap $L_A$ (see FIG. 1*b*). Stator 10, armature 20 and the excitation magnetic field in this context are designed such that a retaining force $F_H$ takes effect when the gap $L_A$ between the stator 20 and the armature 10 is closed.

In the self-excited variant shown in FIG. 1, the armature coil A itself serves as a means for generating the excitation magnetic field. Armature 20 and stator 10 together with the gap $L_A$ (as (working) air gap) form a magnetic circuit, in which the excitation magnetic field is guided. In this context, the armature coil A is arranged at least partially next to the gap $L_A$, thus already in the open position (a) "immersed" partially into the frame 10. The armature coil A can in particular be arranged in a peripheral groove of the armature. In this case, the armature coil A extends almost symmetrically around the longitudinal axis 1. In the present example, the length $d_2$ of the gap $L_A$, is determined by the distance between a shoulder 21 of the armature 20 and a front face of the stator 10 opposite the shoulder.

According to the embodiments of the present invention described here, an electromagnetic linear actuator comprises an elongated armature, supported on a frame which can be moved in the axial direction (longitudinal direction 1) as well as at least one coil for generating a magnetic flux (excitation magnetic field) such that armature and frame attract each other like a lifting magnet. This attracting force, like in "normal" lifting magnets, is the so-called reluctance force, the axial component of which with constant coil current in lifting magnets without impacting the performance curve decreases with the air gap length at least quadratically (if the stray field is taken into account, the decrease is even stronger). With larger working air gaps, no large forces can be generated with a conventional electromagnet for this reason in practice, but with closed working air gaps, greater retaining forces can be effective between the moving part and the frame, however. To be able to accomplish a force in the order of magnitude of the retaining force of the electromagnet across the entire regulating distance of the movable armature, an armature coil is connected with the movable armature, which is permeated by the excitation magnetic field in such a way and/or interacts with this such that, at least with an open (axial) air gap $L_A$, an additional force (Lawrence force among others) acts on the armature coil, which acts in the same direction as the reluctance force (on the armature). In other words, with an open (axial) air gap $L_A$, the excitation magnetic field of the armature coil A closes at least partially across the radial air gap $L_B$, which results in that the armature coil A is permeated with the excitation magnetic field such that an additional force acts on this. If the frame, armature and armature coil are suitably designed, the armature coil will itself generate an excitation magnetic field, which is suitable both for generating a reluctance force like a lifting magnet (i.e. for retaining the armature when the gap is closed), as well as for accelerating the armature based on the previously mentioned additional force effect with the open air gap. An example for this is the linear actuator pursuant to FIG. 1, already previously described.

Simply stated, a linear actuator according to an example of the invention comprises an (electro) lifting magnet, the armature of which is driven (shifted) in addition by the force acting on the armature coil. This makes it possible to provide large forces already at the beginning of the regulating distance in a simple manner. With adequate sizing and current feed, compared with lifting magnets, high electrical efficiencies and very short actuating times can be realized.

Figure 2:
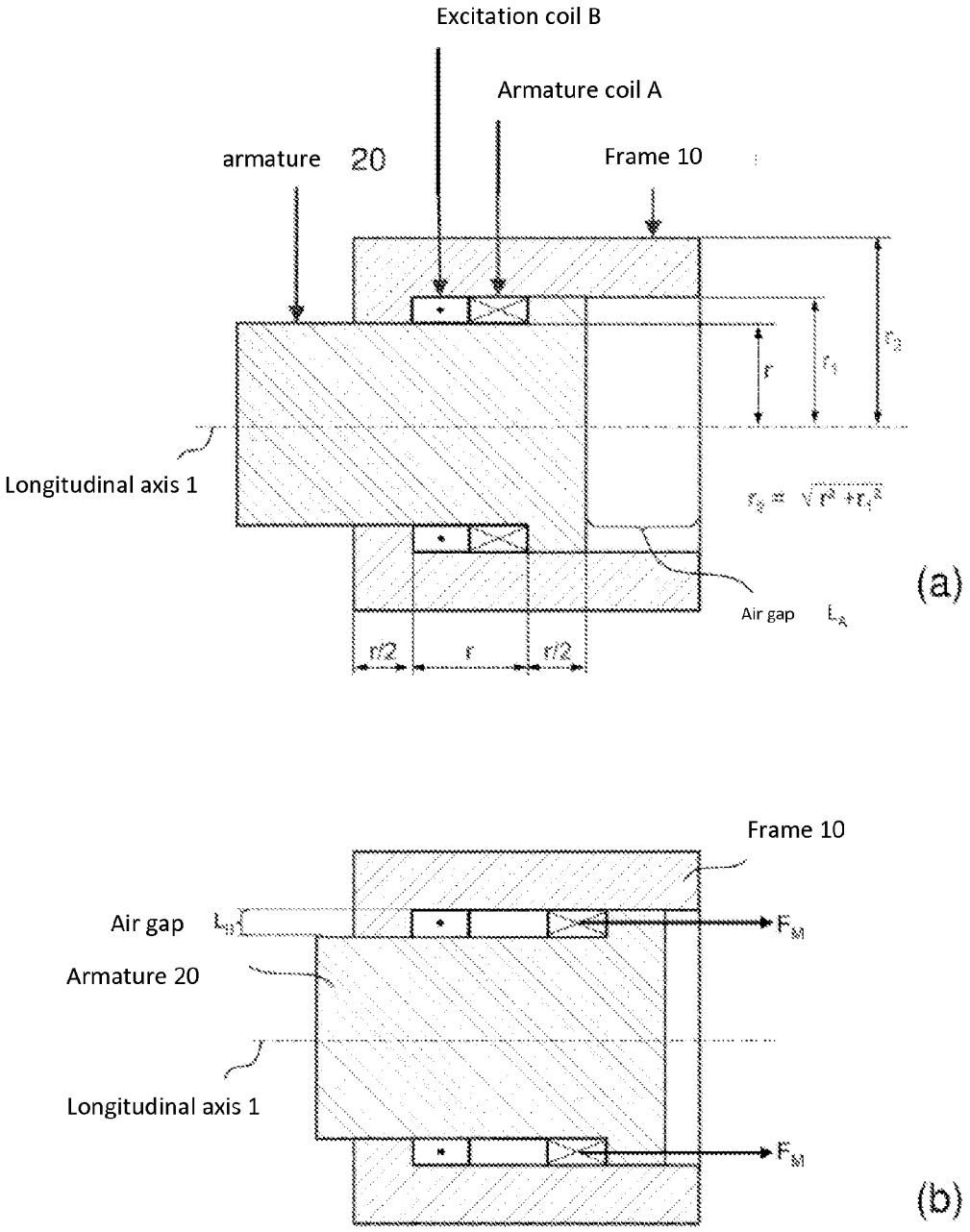
FIG. 2 shows an electromagnetic linear actuator pursuant to a further example of the invention in an opened end position (a) and in a position during the actuation procedure (b)

FIG. 2 relates to a further example of the present invention, in which the excitation magnetic field for accelerating an armature coil A and therefore the armature 20 is not generated from one armature coil A alone (such as with the example from FIG. 1), but in addition with the help of an excitation coil B connected mechanically with the frame. The linear actuator pursuant to the example illustrated in FIG. 2, comprises also a pair consisting of excitation coil B and armature coil A. The actuator illustrated in FIG. 2 can be combined with the actuator from FIG. 1 (see FIG. 5) or be used on its own.

Pursuant to the example from FIG. 2, the linear actuator comprises a frame 10 (stator) and an armature 20 supported on the frame which can be moved axially (i.e. along the longitudinal axis 1). An armature coil A is firmly connected with the armature 20. For this purpose, the armature coil A can be symmetrically wound around the longitudinal axis 1 of the armature 20, if possible. An excitation coil B assigned to the armature coil A is firmly connected with the frame 10. This can be wound coaxially to the armature coil A. During operation, the armature coil A and the excitation coil B are supplied with current such that the coils A, B produce opposite magnetic fields. The coils A, B are arranged next to each other in an open (end) position of the actuator (see FIG. 2*a*) (with as small an axial distance to each other as possible), so that with coils that are electrically connected in series (or also in parallel), the total inductance can be comparatively low, because the axial (i.e. in the direction of movement) components of the magnetic fields of the coils almost superimpose destructively. The coils A, B can also be arranged partially merged into one another (see FIG. 4, for example). The radial components of the magnetic fields superimpose, causing a radial magnetic flux, which produces a force effect in the armature coil A. In order to obtain an overlap of the magnetic fields as optimally as possible, the two coils A, B must produce the same magnetic magnetomotive force; this can be obtained most easily in that two coils with the same number of windings are electrically connected in series. By "radial," generally a direction is understood which comprises a right angle relative to the longitudinal axis of the actuator (i.e. it lies at a right angle relative to the movement of direction), irrespective of whether the actuator is or is not designed axisymmetrically. Radially therefore means "transverse to the axis of motion," irrespective of the cross-sectional form of the actuator.

Figure 3:
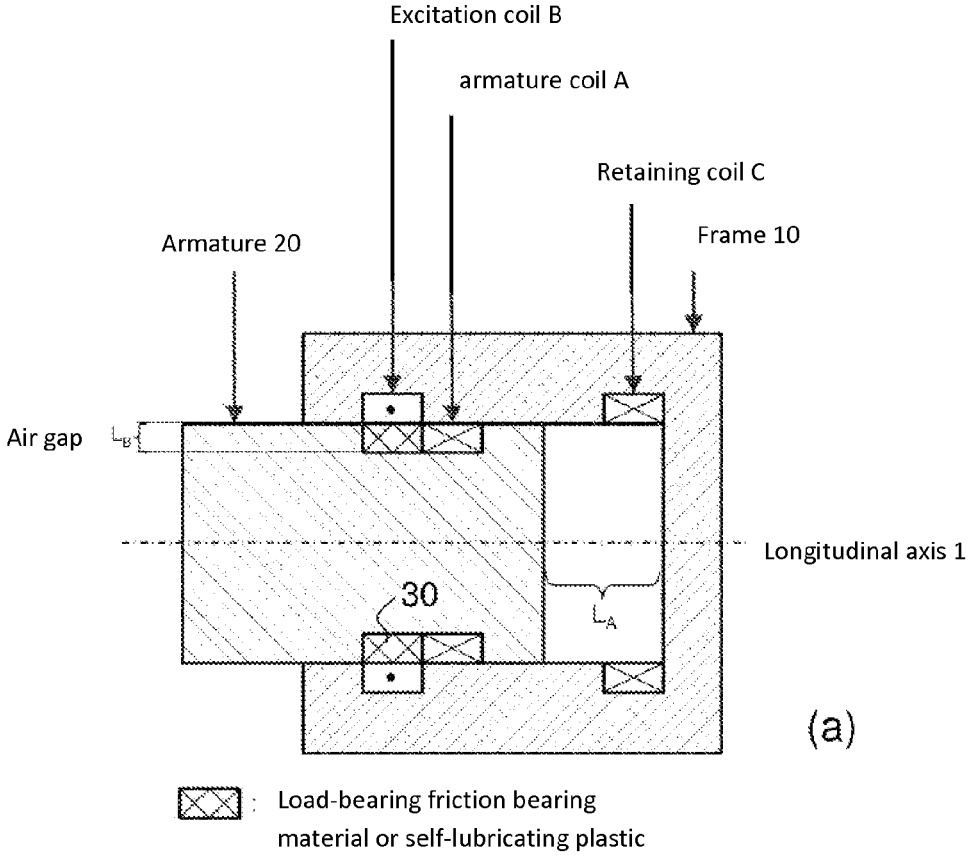
FIG. 3 shows an electromagnetic linear actuator, which is similarly arranged as the example from FIG. 2, wherein the actuator can be held in the closed end position (b)
Figure 3:
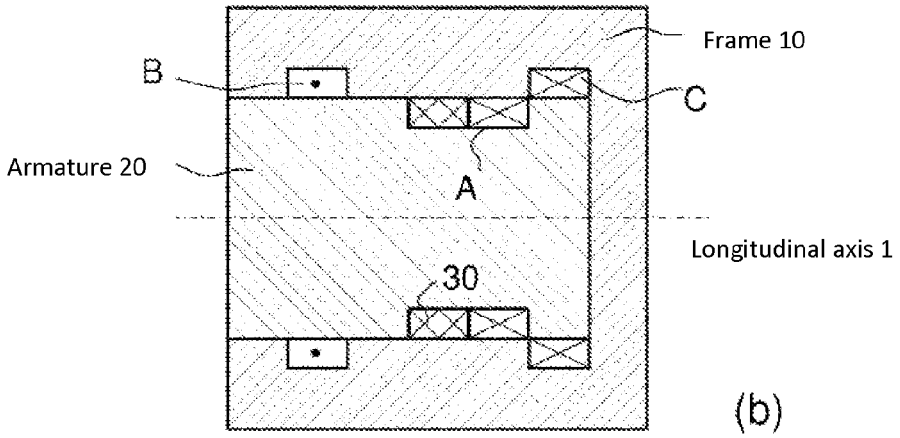
Figure 4:
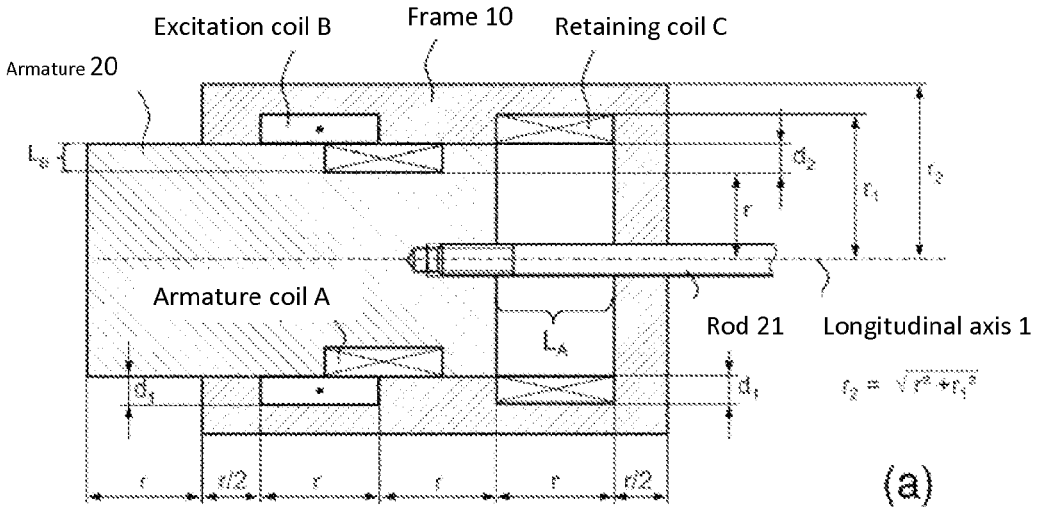
FIG. 4 shows an electromagnetic linear actuator pursuant to a further example of the invention in an opened end position (a) and in a closed end position (b); the arrangement resembles the actuator from FIG. 3.
Figure 4:
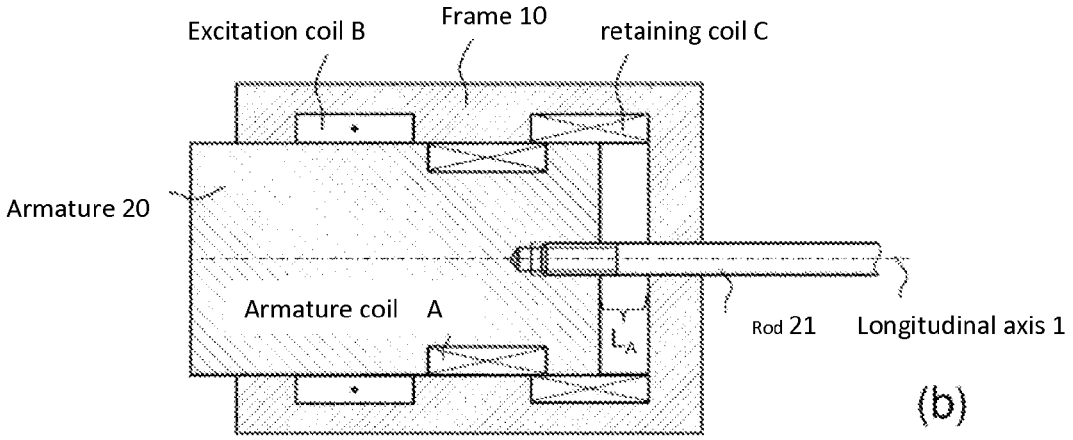

In the present example in FIG. 2, the axial "gap" $L_A$ is to be understood as a space between a front face of the armature 20 and a corresponding front face of the frame 10, and in the present case does not represent an air gap of the magnetic circuit. In the present structural design of the actuator, the armature 20 does not lie against the frame 10 if the gap is closed ($L_A$=0), and consequently no retaining force $F_H$ is effective between the armature 20 and the frame 10 in the closed (end) position. Strictly speaking, the "gap" $L_A$ does not involve an air gap of a magnetic circuit, since the frame is open on the face side. With frames where the frame is closed on the face side, the gap $L_A$ is also an air gap of a magnetic circuit, and a respective retention force can be generated to hold the armature in the closed end position. An example of this type is shown in FIGS. 3 and 4, for example. FIG. 2*b* illustrates the same actuator as in FIG. 2*a*, but with a smaller axial "gap" $L_A$ and a radial air gap $L_B$ with a larger cross-sectional surface between the coils A, B, than in FIG. 2*a*. With the example from FIG. 2, there remains a radial air gap $L_B$ (i.e. transverse to the longitudinal axis 1) along the longitudinal axis 1 between the coils A, B. If current flows through coils A, B, a repulsive reluctance force acts between the excitation coil B in the armature coil A, because when the axial distance of the coils A, B increases, the effective cross-section of the radial air gap $L_B$ also becomes larger and consequently the total inductance of the actuator arrangement increases. With growing distance, the reciprocal compensation of the inductances of both coils fades away. In addition, the armature coil A perceives a Lorentz force based upon the generated radial magnetic field component produced by the excitation coil B (in interaction with the magnetic field generated from the armature coil A), which acts in the same direction as the reluctance force mentioned above. As already mentioned further above, the radial magnetic field component is created by superimposition of the fields from the excitation and armature coil A, B.

A more intuitive observation originates from the magnetic pressure, with which a rough analogy to the heat engine can be produced: Let us consider the armature coil A as piston and the magnetic field B, which is located between the coils A, B in the radial air gap $L_B$, as working gas with the (magnetic) pressure $B^2/(2\mu_0)$, which is decompressed and performs work in the process. In a simple approximation, and if the currents are not too high, the following is applicable: with constant coil currents through the armature coil A and the excitation coil B, doubling the effective radial cross-section of the air gap by displacing the armature coil A, results in halving the flux density in the radial air gap. However, the energy density of the magnetic field goes proportionally with $B^2$, so that after displacing the magnetic field between the coils it only contains just more than half of its original field energy (double the volume, a quarter of the energy density). The energy difference can be performed as work. From this picture it is immediately clear that for a drive to be efficient, the distance between the excitation coil and the armature coil B, A at the beginning of the regulating distance must be as small as possible, because with higher compression, heat engines also become more efficient.

When the end of the regulating distance has been reached, any magnetic field energy which is still remaining could be used in accordance with known electric circuitry, for instance to charge a capacitor or directly one all several additional coils, in particular draw-in coils (when viewed overall as a heat engine, such circuitry is similar to utilizing the residual energy by a turbocharger).

A little less picturesque than the analogy with a heat engine described above but more exact in physical terms is viewing the magnetic pressure gradient ("magnetic tension force"), which has the form $(B\cdot V)\,B/\mu_0$ and has the dimension $Nm^{-3}$. As a result of this pressure gradient, in addition to the Lorentz force, a force acts between coils A, B such that the pressure gradient becomes smaller, which corresponds to a "straightening," and therefore shortening of the magnetic lines of flux. The work performed by this force originates from the magnetic field itself, contrary to the Lorentz force, which is merely transmitted by means of the magnetic field. In contrast to the reluctance force in the electromagnets, the "magnetic tension force" does not act parallel but antiradial to the lines of flux ("straightening" the lines of flux).

FIG. 3 shows a very similar exemplary embodiment to the example from FIG. 2, in which with the closed axial gap $L_A$ (see FIG. 3*b*) the armature 20 can be retained on the frame 10 like a lifting magnet with the help of a magnetic retaining force $F_H$. For this purpose, the frame 10 has a shoulder on its front face, against which a corresponding face of the armature bears if the gap $L_A$ is closed. In the simplest case (i.e. without impacting the performance curve) the frame 10 has the form of a hollow cylinder closed on one side of its face and the armature 20 as the form of a frame 10 fitted into the hollow cylinder. But also other than axisymmetrical cross-sections (transverse to the longitudinal axis 1) are possible, however as well as armature/armature counterpart systems instead of flat front faces.

Other than in the example from FIG. 2, the armature coil A and the excitation coil B are arranged in grooves which are arranged in each case in the surface of the armature 20 and/or the frame 10. In this instance, the grooves normally run peripherally to the longitudinal axis 1, for example. For this purpose the groove in which the armature coil A runs can be wider than the armature coil A itself, so that next to it there is space for a sliding-bearing material 30, which improves the gliding characteristics between the armature 20 and the frame 10. The sliding-bearing material 30 is a self-lubricating and electrically insulating plastic material, for example. The groove in the armature 20 can alternatively be completely filled with the armature coil A (including the casting compound). Starting off from the open end position of the linear actuator (see FIG. 3*a*) the groove in the armature 20 is wide enough so that in case of a small shift of the armature, a radial air gaps remains between the armature coil A and the excitation coil B, similarly as in the example from FIG. 2. In this context, the term air gap must not be understood to mean that air is actually present in the gap, but what is rather important is that the material in the air gap is not soft magnetic. The radial air gap $L_B$ can also be closed (just as in the example of FIG. 3*b*) at the end of the lift (or shortly before). Consequently, this leaves only an axial air gap $L_A$ (which disappears on the lift end), which then (after closing the radial air gap) due to the effect of the reluctance force (caused by the magnetic field of the armature coil A and the retaining coil C) is closed and is kept in the closed condition. Armature coil A and retaining coil C are supplied with current equidirectional for this purpose. The successive closure of the radial air gap $L_B$ is incidentally accompanied by a reluctance force when the coils A, B are supplied with current in opposite directions, where such force is applied on the left rear flank of the groove, viewed in the direction of movement, in which the armature coil A is housed, and which also contributes to the closing of $L_A$.

To increase the force onto the armature 20 at the end of the regulating distance and to ensure a high retaining force $F_H$ on the closed axial gap $L_A$ using minimum power consumption, an additional excitation coil C can be arranged in or on frame 10. In the present example, the retaining coil C is likewise arranged in a groove of the frame 10, similarly like the excitation coil B. The retaining coil C is not mandatory for the actuator to function. Using a suitable layout, the necessary excitation field for producing the retaining force $F_H$ can also be produced by the armature coil A; in this case, the rib between the groove, in which the armature coil A is arranged, and the front face of the armature 20 should be distinctly smaller (than the length r/2 represented in the corresponding FIG. 2*a*), (or even zero). The excitation field necessary for the retaining force $F_H$ could alternatively also be generated by permanent magnets that are arranged in the frame 10 (see the example from FIG. 5). Viewed on its own, the retaining coil C operates essentially like the coil of a traditional electro-lifting magnet The example in FIG. 4 is essentially identically structured as the example from FIG. 3. In the present example, the armature coil A and the excitation coil B are coaxial and in the open (end) position are arranged into each other at least partially, so that the coils A, B partially overlap in the axial direction. Such type of arrangement can have very low initial inductance, wherein the coils A and B can be connected in series or in parallel. In the present case, the armature coil A is also arranged in a groove running circumferentially around the armature 20. Other than in the example pursuant to FIG. 3, the armature coil is however distributed across the entire cross-section of the groove, and no separate sliding-bearing material 30 (see FIG. 3) to form a sliding surface is provided. As can be seen in FIG. 4*a* (open end position of the actuator), during the movement, the excitation coil B will "see" a radial air gap $L_B$ for as long as the excitation coil B and the armature coil overlap (in the axial direction). With increasing displacement of the armature 20 (see FIG. 4*b*), the groove of the armature coil A also moves further. As soon as the grooves of the armature coil A and the excitation coil B no longer overlap (in the axial direction), the excitation coil B no longer "sees" a radial air gap $L_B$ and the field of the excitation coil B is short-circuited across armature 20 and frame 10 (see FIG. 4*b*). When examined in detail, this short-circuiting of the radial air gap $L_B$ occurs continuously, because of the local saturation of the iron. The magnetic short-circuit is (almost) perfect only when the iron of the armature and the iron of the stator overlap sufficiently (approximately r/2). Meanwhile, the armature coil A reaches the sphere of influence of the further excitation coil C (retaining coil), the excitation magnetic field of which is equidirectional to the field of the armature coil A and which pulls the armature 20 up to the end position of the armature (the front face of the armature contacts the inner front face of the frame). In this end position, the armature 20 is then retained due to the field of the coils A and C (retaining force $F_H$).

As previously mentioned, the armature coil A and the excitation coil B can be wound such that their inductances (because of a destructive superimposition of the respective magnetic fields) in the open starting position (see FIG. 3*a* or 4*a*, for example) compensate extensively, so that the overall arrangement (with coils A, B connected in parallel or in series) has a very low initial inductance, which has the advantage that very high dynamics (i.e. short absolute actuating times) can be obtained.

Figure 5:
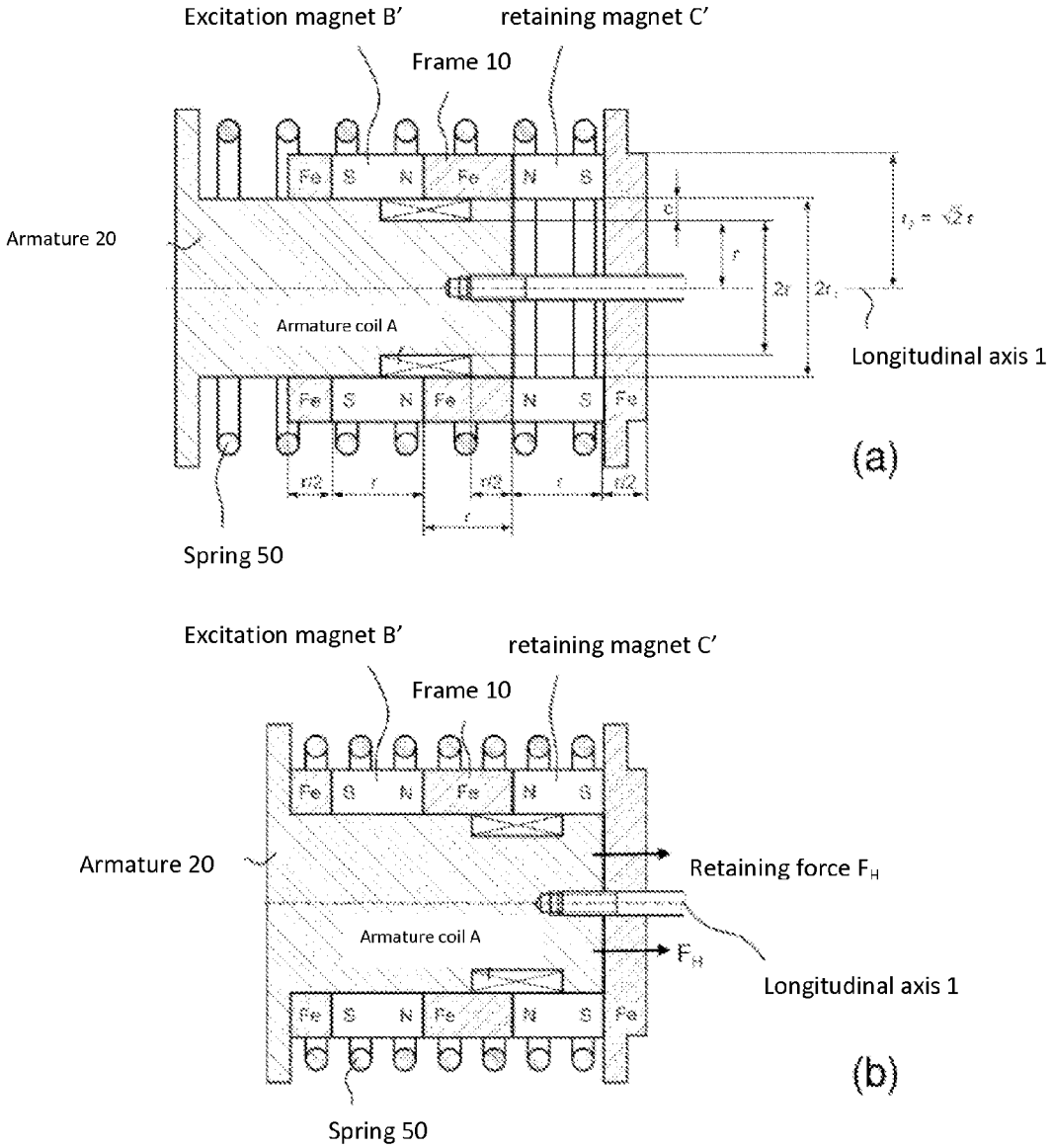
FIG. 5 shows an electromagnetic linear actuator for tensioning a spring actuator pursuant to a further example of the invention in an opened end position (a) and in a closed end position (b); the arrangement resembles the actuator from FIG. 4, whereas the excitation magnetic fields are generated by permanent magnets, however.

FIG. 5 shows a further embodiment that is similarly structured as the example from FIG. 4. Other than with the actuator pursuant to FIG. 4, the excitation coil B and the retaining coil C are replaced by corresponding permanent magnets B' and/or C'. The permanent magnets B', C' are arranged on or in the frame 10 such that they produce a similar magnetic field as the (excitation) coils B and/or C that are supplied with current in the example in FIG. 4. In the present case, the permanent magnets B' and C' are designed as part of the frame 10. But the permanent magnets can also be arranged in grooves, as in the example from FIG. 3, which surround the inside of the frame 10 in the circumferential direction. The permanent magnets can moreover also be attached on the inside of the frame (same as the excitation coil B from FIG. 2). (It is also possible, to exchange the "roles" of the frame and armature, and to attach the permanent magnets on the armature and instead attach the previous armature coil on the frame.) In the example represented, the permanent magnets B', C' have the form of a hollow cylinder. The permanent magnets can also be built-up from several individual magnets, however. In addition to the preceding linear actuators, the present example shows a variant, in which a spring 50 is tensioned by the movement of the linear actuator and is kept in the tensioned condition. Even if is it not shown in every example, any of the shown embodiments can be used in order to tension a spring. Furthermore, each of the illustrated actuators (if necessary, with a minor in adaption in design) can keep the spring in the tensioned condition. This is possible with very low electrical power consumption, or even without any power (see FIG. 5), with all embodiments except for the example from FIG. 2. In this manner, very simply structured "spring actuators" can be realized.

Electric current is supplied to the armature coil A in such a way, that (if the fields would be viewed individually in each case) the resulting magnetic field of the armature coil is aligned opposite to the excitation magnetic field of the permanent magnet B'. As described with preceding examples, the superimposition of the magnetic fields of armature coils A and permanent magnet B' results in a radial field component, which results in a force effect in the armature coil, which drives apart the armature coils A and the permanent magnet B'. Consequently, in the opened end position (see FIG. 5*a*) a force acts on the armature coil A, which, together with the reluctance force acting on the armature is large enough across the entire regulating distance in order to tension the (compression) spring 50 and to move the armature against the spring force into the closed end position (see FIG. 5*b*). In the closed end position, due to the excitation field of the retaining magnet C' as well as because of the magnetic field of the armature coil A, a retaining force $F_H$ acts, which keeps the armature in the closed end position and therefore keeps the spring tensioned. If it is suitably sized, the armature can also be held against the spring force de-energized, simply because of the excitation field of the retaining magnet C'. If the current feed to the armature coil A is reversed ("negative excitation"), the magnetic field of the retaining magnet C' can be compensated by the field from armature coil A and the retaining force $F_H$ onto the armature 20 disappears (and/or becomes smaller than the spring force). The spring 50 can slacken, whereby the actuator is moved again into the starting position (see FIG. 5*a*). In addition, a Lorentz force would act on the armature coil A, but in the opposite direction than when tensioning the spring, that is towards the opening of the axial air gap, which will accelerate the armature 20 additionally.

Figure 6:
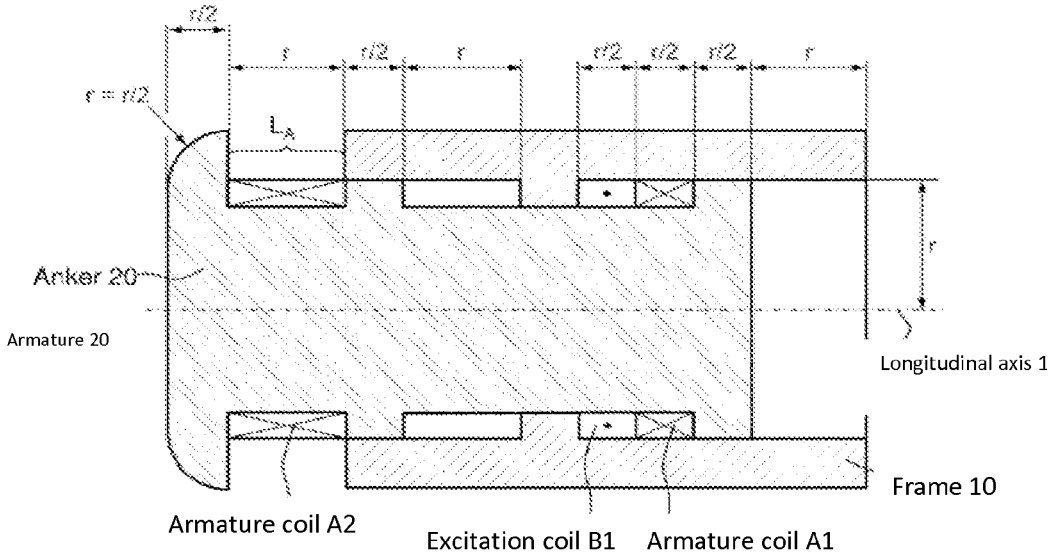
FIG. 6 shows an electromagnetic linear actuator pursuant to a further example of the invention; the actuator can be considered as being a combination of the examples from FIGS. 1 and 2.

In FIG. 6, a linear actuator is illustrated as a further embodiment, which can essentially be considered as a combination (mechanical series connection) of the actuators illustrated in FIGS. 1 and 2. The actuator from FIG. 6 consequently has two armature coils A1 and A2 and one excitation coil B1, wherein the pair of coils A 1 and B 1 corresponds to the pair of the armature coil A and/or the excitation coil B from the example from FIG. 2 and the (self-excited) armature coil A 2 of the armature coil A from the example from FIG. 1. If the end position is closed, a retaining force $F_H$ acts between armature 20 and frame 10 in the same manner as in the example from FIG. 1. During the linear actuation procedure, when compared with the example from FIG. 1, the additional pair of coils (excitation coil B 1, armature coil A 1) provides an additional electromagnetic force effect on armature coil A 1 and therefore on armature 20.

Figure 7:
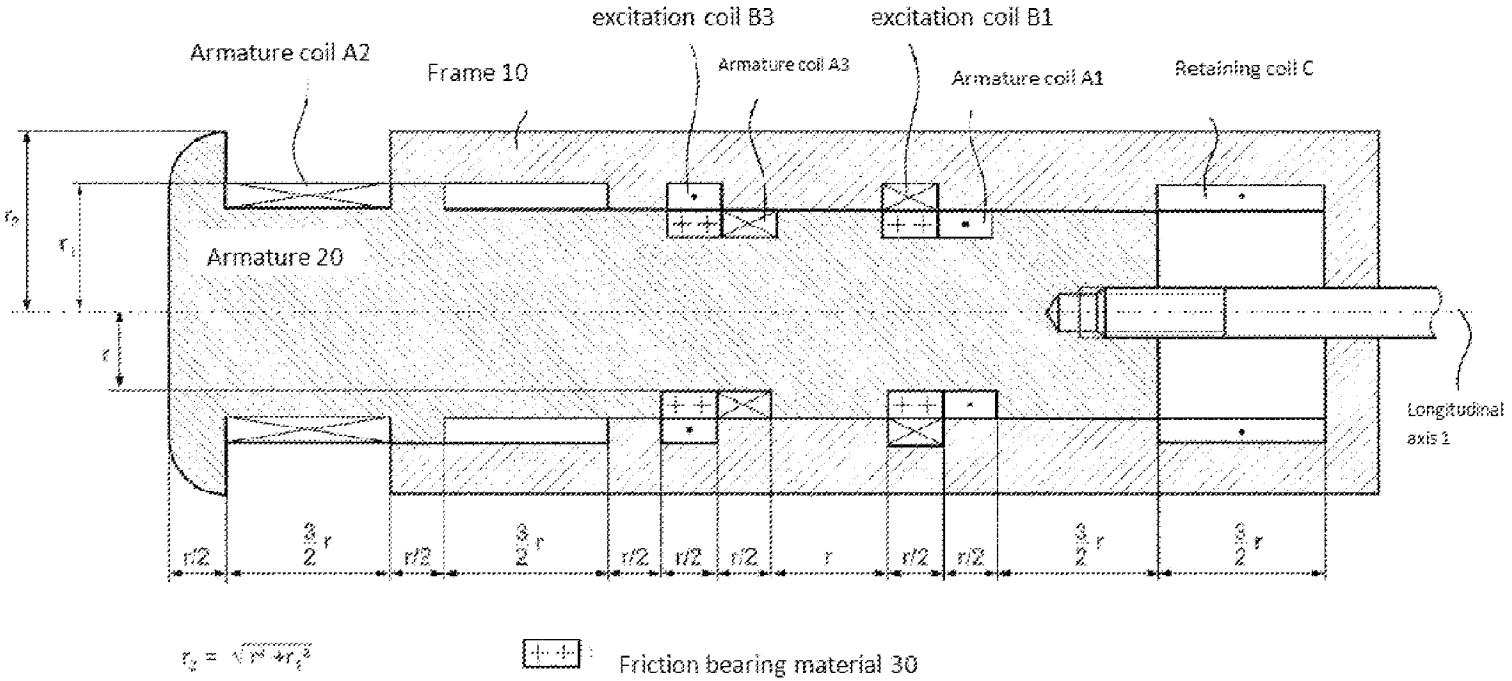
FIG. 7 shows an electromagnetic linear actuator pursuant to a further example of the invention. The actuator can be considered as being a combination of the examples from FIGS. 1 and 3.

The magnetic linear actuator pursuant to FIG. 7 can considered to be a combination of the embodiments from FIGS. 1 and 3, which provides a particularly high magnetic force across the entire regulating time and can comprise a short actuating time, because of the high volume-specific force. The armature coil A 2 has the same function as in the preceding examples from FIG. 1 or FIG. 6. The retaining coil C has the same function as in the example from FIG. 3. The coil pairs A1, B1 and A3, B3 have in each case also the same function like the coils A and/or B in the example from FIG. 3. The electromagnetic linear actuator pursuant to FIG. 7 can also be seen as a mechanical series connection of the actuator pursuant to FIG. 1 and of the actuator pursuant to FIG. 3, wherein compared to actuator from FIG. 3, the pair made up from excitation coil B and armature coil A is provided twice with the actuator pursuant to FIG. 7. To increase the electromechanical forces with the cross-sectional surface of the actuator remaining the same, it is theoretically possible that any optional number of pairs made up from armature coil and corresponding excitation coil can be provided. Same as in the example from FIG. 3, the armature coils A 1 and A 3 do not fill the entire cross-section of the associated grooves in armature 20.

A sliding-bearing material is arranged in the grooves next to the respective armature coil A1, A3 and below the associated excitation coil B1, B2, such as a synthetic material. Said material serves for filling the groove, which influences the force characteristics on the one hand, and on the other the sliding-bearing material can serve as part of the friction bearing which is formed by armature 20 and frame 10.

The armature coil A1 and the retaining coil C are supplied with current in operation such that the resulting magnetic fields are unidirectional. The armature coil A 3 is supplied with current such that its magnetic field is oriented reversed to the field of the armature coil A1. Finally, the excitation coils B1 and B3 are supplied with current such that their magnetic fields in the opened starting position of the actuator almost compensate the magnetic fields of the associated armature coils A1 and A3, so that a low overall conductance can be achieved. The coils B1, A1 and B3, A3 are connected in pairs in series and are forming low inductance sub-circuits. Parallel thereto (or supplied separately), the coils A2 and C are connected. What has been said in this connection with respect to FIGS. 2 to 4 applies accordingly. The axial distance of the armature coils A1 and A3 is sized such that in the closed end position of the armature 20, the armature coil A3 will be positioned in and directly next to the excitation coil B1. In the same manner, the distance between the excitation coil B1 and the retaining coil C is sized such that in the closed end position of the armature 20, the armature coil A1 will be lying in or near the retaining coil C. In the closed end position, the excitation magnetic fields of the retaining coil C as well as of the armature coil A2 ensure an adequate armature force, in order to retain the armature 20 against a potential restoring force (e.g. spring force) on the frame 10.

All embodiments have in common that the armature 20 can be an axially guided soft magnetic component extended along a longitudinal axis 1 which is axially guided in the frame 10. The armature coils A, A1, A2, A3 can either be countersunk in a groove circumferentially running along the periphery of the armature, or be wound up along the circumference of the armature (see FIGS. 2 and 6). For this purpose, the coils can be wound from an electrically insulated shaped wire (with a rectangular profile, for example). The armature coils can be cast with a casting resin according to known methods, wherein the casting resin can comprise a powder. In this context, the powder can consist of a ceramic material, for instance of a material with a high thermal conductivity, or of another material with a correspondingly high thermal conductivity.

Generally it can be noted that armature 20 and frame 10 as well as the excitation coils B, B1, B3 (as well as, A in a self-excited case) should be configured such that the resulting excitation magnetic fields (and/or the resulting excitation magnetic fields), can interact with the (or these) of the armature coil A, A1, A3, will be concentrated by a corresponding geometric configuration of the magnetic circuit of the armature coil/s, wherein in the open end position of the actuator, the excitation field will radially permeate the armature coils, in order to accomplish an axial force effect (since the coil currents flow in circumferential direction).

As previously mentioned, the magnetic field with which the armature coil A interacts, can be generated by the armature coil A itself (see FIG. 1 with an axial air gap $L_A$, so that the secondary flow permeates and drives the armature coil A radially). Alternatively, means that are considered for generating the excitation magnetic field are excitation coils B, B1, B3 (see FIG. 3) which are fixed on the frame, or corresponding permanent magnets B' (see FIG. 5).

The excitation coils B, B1, B3 can be larger in a radial direction (e.g. larger diameter) than the corresponding armature coils A, A1, A3, so that armature and excitation coils can be slid into each other at least partially. In this context, armature 20 and frame 10 can slide on top of one another such that radial air gaps are closed depending on the armature position (see FIGS. 3 and 4). The armature coil A and the excitation coil B can alternatively also almost be of the same size (see FIGS. 2 and 6). In this case, the armature coil and the associated excitation coil can be arranged directly side-by side in the opened end position of the actuator.

Soft magnetic materials with maximum possible saturation polymerization and maximum possible high relative permeability should be used for the armature and/or the frame. The electrical conductivity of armature and frame should be as low as possible, in order to keep eddy current losses low. For this purpose, similar as with transformers, the material/s for the armature and/or the frame for the suppression of eddy currents can be laminated ("electrical sheet/lamina) or can consist of a composite powder material or be provided with slots. The current supply (i.e. the cable) for the armature coil/s can be brought out through an axial bore from the armature 20.

The current supply can be ensured by twisted wires or stranded wire. A suitable material for this purpose is beryllium bronze, for example.

As already previously mentioned, armature coils should be connected in series or parallel with corresponding excitation coils and be designed and arranged such that the respective magnetic fields extensively compensate each other at the beginning of the regulating distance, so that the inductance of the arrangement at the start of the regulating distance is correspondingly low. A certain axial offset must remain between corresponding, however, otherwise the drive force disappears or changes its sign.

The magnetic force acting on armature 20 must be brought out of the frame 10 by means of a rod 21 (bar), in order to facilitate a mechanical coupling onto further machine elements. The actuator can be combined with a spring 50 (see FIG. 5 or spring FIG. 8), so that it can tighten and retain these in the tightened condition against the action of the spring force in an end position (i.e. at the end of the regulating distance). By switching off or by reducing the magnetic field responsible for retaining the armature 20 in the end position, the spring actuator can be released as needed, which results in that the actuator rebounds into the opened starting position. If a permanent magnet is used, the spring can be retained in the tensioned position without any power. In order to release the spring actuator, the field of the permanent magnet (see magnet C' in FIG. 5) is compensated by an opposite orientated field of a coil at least partially, so that the retaining force $F_H$ becomes smaller than the spring force and the spring rebounds into the starting position. The armature 20 can moreover be accelerated additionally during the rebounding by means of the electromagnetic forces acting on the armature coil/s, which makes even shorter actuating times possible.

In combination with the spring, the illustrated linear actuators, previously known spring actuators, and electrical switches, for example, can be advantageously replaced (short actuating times, high forces, small number of moving parts). This is applicable particularly for such drives that are equipped with coils arranged in pairs, from which in each case one is mechanically connected with the armature (armature coil) and the other is connected with the stator (excitation coil). This construction has advantages because of which it is particularly suited for highly dynamic drives.

This configuration has advantages due to which it is particularly suitable for highly dynamic drives:

- at the beginning of the lift, particularly large forces can be presented
- at the beginning of the lift, the inductances of the conjugated (repulsing each other) coils can compensate extensively, which can be accomplished easily by the same number of windings and series connections. Compared with traditional lifting magnets, this results in a vastly faster buildup of force (smaller dead time).

In the embodiments of the invention disclosed in FIGS. 3, 4 and 7, the mentioned advantages are associated with disadvantages, however, which can actually represent exclusion criteria for some applications that can be economically interesting.

1. Inductance 1.1 The desired low initial inductance can result in high current rise rates when the drives are switched on, which in many semiconductor switches (e.g. transistors) can result in local overheating (so-called hotspots). (Electro-) mechanical switches can be destroyed or be prematurely worn during the contact chatter a result of sparking or discharges by arcing. To safely prevent damaging switches, these have to be either oversized, which results in additional costs. Or an inductance with a closed magnetic circuit and a highly permeable core material must be connected in series with the drive ("magnetic switch protection"), which also causes costs and at the same time increases the ESR [electron spin resonance] of the electrical circuit.

2. Internal Groove

Excitation coils fixed on the stator, which can act repulsing on (armature) coils attached on the armature, are inserted into internal grooves, for example. This arrangement (see FIGS. 3, 4 and 7) is advantageous when it is important to produce a force which is as high as possible at a given armature radius across a particularly long lift. Besides that, however, it is also affected with disadvantages:

2.1 Generally, it is not possible to do without a coil former for the excitation coils attached to the stator, which increases the effective (radial) air gap ($L_B$) and increases the necessary cross-section of the drive (and therefore its mass and the material used) on the one hand, and on the other decreases its "force constant" (what is meant is F=F (x, I) with F=drive force, x=lift position and I=current strength).

2.2 With (stator) excitation coils that are arranged in internal grooves, there is the risk in designs with long strokes that an edge of the armature collides with an edge of the stator lying inside the groove during a lift movement. This risk must be particular considered in view of increasing play of the drive due to wear. This can be countered, however, by working with particularly high quality materials, great accuracy during manufacturing and/or with comparatively large radial (parasitic) air gaps. However, these measures require either additional costs or they decrease the drive efficiency.

Apart from the above-mentioned disadvantages, which may be given in some embodiments of our invention, there is a further disadvantage, which affects all embodiments represented in FIGS. 1 to 7:

(Great) forces occur on (soft) copper. These forces must normally be absorbed by casting compounds and be transferred to stator and/or armature. Particularly in view of the comparatively small front faces of the coils (and the smooth grooves) the technical challenges associated therewith are evident for a person skilled in the art.

Figure 8:
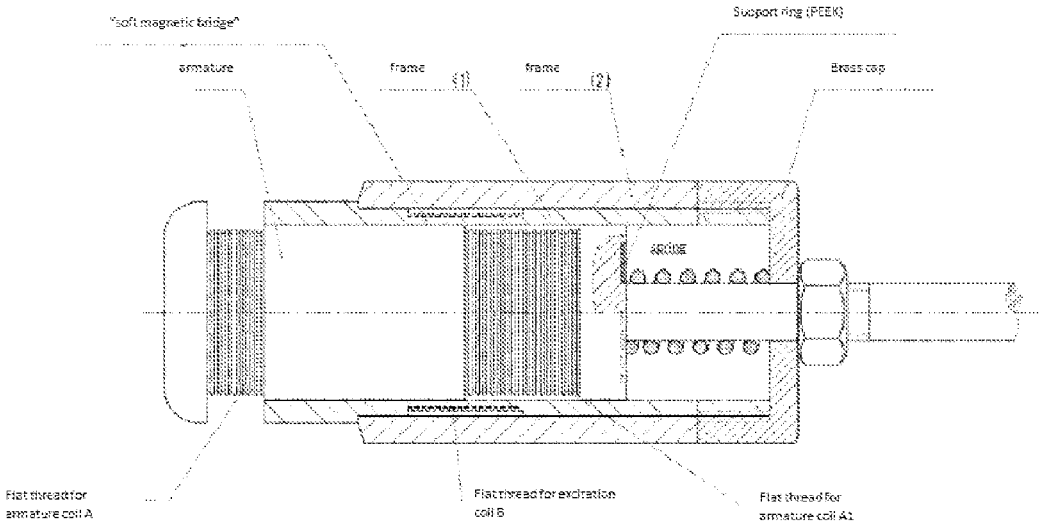
FIG. 8 shows a linear actuator, which is particularly robust and particularly easy to manufacture. The winding of the coils are wound at least partially into the flat threads (wherein the flat threads can also be replaced by other types of threads or by intermittent "fins," that is a plurality of grooves formed by intermittent ribs. What is decisive is that the windings are at least partially wound in recesses in the armature (material)). The drive operates comparable to the one illustrated in FIG. 6, however the excitation coil and the assigned armature coil, which have the ability to repel each other, have different diameters (such as also pursuant to FIG. 4). Contrary to the previously illustrated drives, there is soft magnetic material radially between these armatures (refer to the "flat thread" from frame (1)) which must saturate first before the drive can output a greater force.
Figure 9:
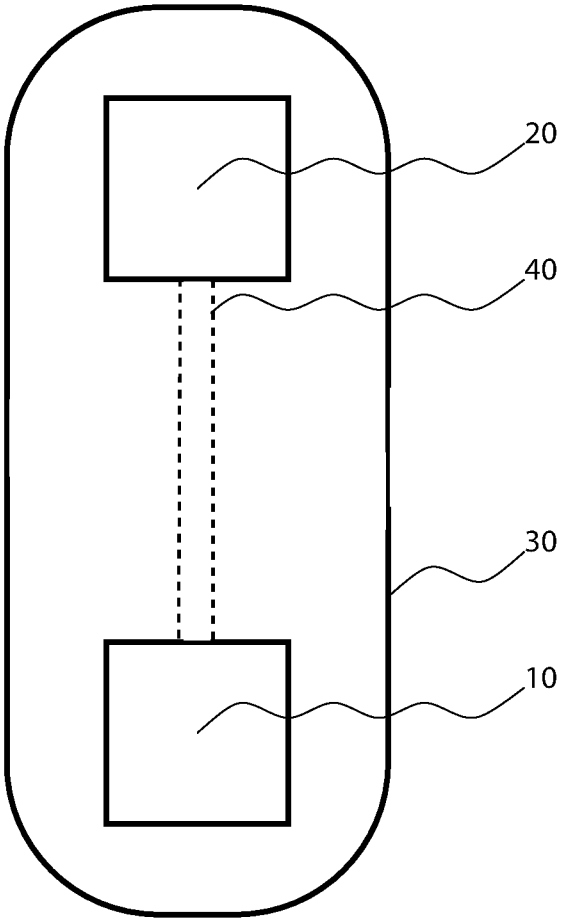
FIG. 9 is a diagrammatic view of a high-voltage power switch with a linear actuator 10, an electrical contact 20, a gas chamber 30, and a rod 40.

All of the mentioned disadvantages can be prevented by arrangements, such as they are represented in FIG. 8. FIG. 8 demonstrates to us by way of an example for a drive with a first armature coil A wound onto the armature as well as a (stator) excitation coil B and a second armature coil A1 which is assigned to this excitation coil B.

The frame is composed of multiple soft magnetic components, wherein that part, in which the armature is moving (frame (1)), is provided with an external instead of an internal groove. Into this groove, the excitation coil B which is allocated to the second armature coil A1, is wound. The external groove will then be enclosed magnetically with a further soft magnetic material, which in FIG. 8 occurs by means of the frame (2) component.

The illustration shows a drive in its initial lifting position, the windings are not drawn in. As can be seen, the external groove forms a type of "soft magnetic bridge" in the initial position of the lift, between the overlapping coils (excitation coil B, second armature coil A1). So that it cannot come to a non-disappearing repulsive interaction between these coils, these must naturally be supplied with current in opposite directions. The current induces a magnetic flux in the "soft magnetic bridge," which, due to the high relative permeability of the soft magnetic working materials, produces a high initial inductance of the drive (it is advantageous to provide the reciprocally assigned coils with approximately the same number of windings and to connect them in series). This high initial inductance permits the switch used for switching the drive to become completely conductive, before a large current flows through the drive coils. This preserves the switch (see above).

The drive starts moving when the magnetic flux has passed through the 'soft magnetic bridge "in the direction of movement, is saturated. It then acts like other drives according to the invention in combination with a proportional magnet (the armature movement shortens the magnetic lines of force in the saturated "soft magnetic bridge" in the direction of movement).

According to FIG. 8, the armature slides beyond it in a continuous tube-like entity, and there is no longer the possibility that "edge collides with edge." According to FIG. 8, it is easy to keep the parasitic (radial) air gap small.

All problems shown above are thus eliminated except for the force transmission "from copper onto the iron." This last problem is dealt with according to FIG. 8, in that the outside grooves on the armature and the stator are executed either cut as (flat) threads or a plurality of small additional grooves are introduced (the grooves are for example formed by a plurality of parallel ribs, interrupted in the circumferential direction and running around the periphery). The winding wire is completely or partially wound into these smaller grooves and/or into the (flat) thread, and is subsequently cast like before. On the one hand, this facilitates to distribute the force acting on the copper onto the flanks of the grooves and/or the threads, and the casting compound is ingeniously interlocked with the armature. On the other hand, a part of the force does no longer occur as (Lorentz) force on the copper but rather as a so-called magnetic lateral pressure on the flanks of the grooves and/or of the threads, and thus on a much more robust component, that is the armature itself, which normally consists of an iron alloy. In addition, the windings lying in the grooves/threads are electromagnetically pressed into same during operation; this effect is frequently utilized in standard rotating electrical machines. By applying known measures such as using a suitable varnished wire (in particular polyamide imide insulated lacquered copper wire and in particular profile wire) and/or suitable casting compound, insulation problems between winding and "iron" can be safely prevented by any specialist. As an additional measure for insulating the armature against the coils, the armature can naturally also be provided with electrically insulating layers by employing known methods, such as by immersion, vapor deposition, anodizing, etc. In this context, the application of the insulating layers according to known measures can be limited to the areas that are electrically relevant; but it is also possible to coat the entire armature, where the coating can then also serve as part of the friction bearing, which can form the armature in the frame (1), as long as no separate antinode or rod support is provided (which is formed with soft magnetic bearing metal, for example).

As already mentioned previously, the above-described drives according to the invention are well suited in combination with springs to replace known spring-operated mechanisms in electrical circuit breakers (as direct drives): This is applicable for all embodiments. In this context, the possibility is particularly interesting to install the drivers directly into the gas compartments of high-voltage circuit breakers or into the (vacuum) tubes of low and medium voltage circuit breakers. This makes it possible to dispense with complex seals (e.g. rotary seals for SF6 insulated high-voltage circuit breakers or metal bellows in the case of vacuum interrupters) and significantly reduces the number of moving parts which on the one hand is cost-saving and on the other is beneficial for reliability. Because of the dynamics that are far higher when compared with traditional magnetic drives, are particularly suitable for synchronized switches (i.e. switching with zero current), and that even for such where the drives are arranged traditionally outside of the gas and/or vacuum compartments.

In conclusion, a switching cycle and an advantageous wiring circuit are described with reference to the example of the drive illustrated in FIG. 8.

The drive has three coils, that is a first armature coil A as well as an excitation coil B and a second armature coil A1 assigned to the excitation coil B. The excitation coil B in the second armature coil A1 have the same number of windings, for example, and are connected in series such that they generate reverse magnetic fields. For the initial actuation of the drive, a capacitor is preferably charged and is discharged across the coils A1, B that are connected in series, that is while the armature is in the initial lifting position, which means that the axial working air gap which belongs to the first armature coil A is therefore fully opened first. In this context, enclosing the excitation coil B and the armature coil A1 with soft magnetic material on all sides through armature, frame (1) and frame (2) initially produces a high inductance (closed magnetic circuit) and therefore to a small initial rate of current increase. This protects the thyristor. The magnetic flux induced by the excitation coil B and the second armature coil A1 soon results in a partial saturation of the magnetic circuit in the area of the smallest (effective) cross-section, i.e. of the "soft magnetic bridge" formed by stator (1) (in FIG. 8 designed as the flat thread of the excitation coil B). For exemplification, one can imagine two magnetic partial circuits, that is one around excitation coil B and one around the second armature coil A1, which share a common path with the "soft magnetic bridge." Because of the partial saturation, the magnetic circuit opens very quickly, the inductance of the series connection (A 1, B) decreases rapidly, and the current increases greatly. As a result of the saturation, a force is generated on the armature and on the second armature coil A 1, which moves the armature against the compression spring such that the axial air gap of the magnetic circuit of the first armature coil A, a draw-in coil which has not been viewed previously, is closed. The armature coil A can be connected with the other coils in series or in parallel, whereas a series connection reduces the dynamics of the drive. The armature coil A can also be supplied from another power source, or be supplied with current or from a further switch/thyristor with some delay. When the end position of the lift has been reached, the axial working air gap above the armature coil A is smaller than the radial air gap which is given by the height of the windings of the armature coil A (approximately), and the arrangement increasingly works like a conventional lifting magnet (see FIG. 1); a current through the armature coil A therefore creates a retaining force, when the armature approaches the closed end position (not shown).

With a sensible design, this retaining force can keep the illustrated compression spring tight. So that the drive which is driven from the compression spring does not snap back immediately but can be kept longer in the end position, means must be provided for the power supply to supply current to the armature coil A appropriately. An interruption of the current therefore results in the spring operated reset of the drive into the initial position of the lift (opened end position). A drive according to FIG. 8 can obviously be additionally provided with a retaining coil C as shown in the example from FIG. 7, so that the retaining force against the spring which can be illustrated permanently can be approximately doubled if the cross-section of the drive stays the same. in the vicinity of the retaining coil C, the arrangement functions like a known electromagnet and/or lifting magnet, and during the design of the drive, correspondingly multifold known structural methods for electromagnets can be used (for example, armature-armature mating component systems, pressure pipes, means for attenuating eddy currents, squirrel-cage windings, etc.).

The invention claimed is:

1. An electromagnetic linear actuator, comprising:

a stator at least partially made of soft magnetic material;

an armature at least partially made of soft magnetic material and being supported on said stator for movement relative to said stator along a longitudinal axis, said armature and said stator forming a gap therebetween along the longitudinal axis in an open position and lying against one another in a closed position with said gap closed;

a first armature coil connected to said armature and configured to transmit a force acting on said first armature coil to said armature; and a second armature coil connected to said armature and configured to transmit a force acting on said second armature coil onto said armature;

a device for generating an excitation magnetic field guided at least partially by said stator and said armature and directed such that a force acts on said first armature coil when current flows therethrough and the force is transmitted to said armature in order to close said gap, said device for generating the excitation magnetic field including an excitation coil adjacent to, and associated with, said second armature coil and mechanically connected to said stator;

said stator, said armature and the excitation magnetic field being configured such that a retaining force can take effect when said gap between said stator and said armature is closed;

said second armature coil and said excitation coil associated therewith, upon excitation with a current, generating opposite magnetic fields that are superposed at least in the open position and thus form an excitation field with a field component oriented transversely to the longitudinal axis; and in an open position, said second armature coil and said excitation coil associated therewith being adjacently arranged such that, when said coils are excited with current, the field component oriented transversely to the longitudinal axis interacts in such a manner with said second armature coil that a force closing the gap acts on said second armature coil.

2. The linear actuator according to claim 1, wherein:

said armature and said stator, together with said gap formed as an air gap, form a magnetic circuit in which the excitation magnetic field is guided;

said first armature coil serves as means for generating an excitation magnetic field, wherein said first armature coil is disposed on said armature to be located in the open position partially in the longitudinal direction adjacent the air gap, by dipping into said stator.

3. The linear actuator according to claim 1, wherein:

said armature and said stator together with the gap formed as an axial air gap form a magnetic circuit in which the excitation magnetic field is guided;

said first armature coil serves itself as means for generating an excitation magnetic field, wherein said first armature coil is disposed in such a manner on said armature and said frame and said armature are designed in such a manner that in the open position of the armature the excitation magnetic field is concentrated in a radial direction transversely to the longitudinal axis and extends radially through said first armature coil.

4. The linear actuator according to claim 2, wherein said armature is guided along the longitudinal axis sliding in said stator and said armature is formed with a stop on which, when the air gap is closed, a front surface of said stator rests, so that an almost closed magnetic circuit is formed that guides the excitation field.

5. The linear actuator according to claim 2, wherein said first armature coil is guided around the longitudinal axis of said armature.

6. The linear actuator according to claim 2, wherein said armature and said stator are designed in such a manner that in the closed position the excitation field runs transversely to the longitudinal axis, and is magnetically at least substantially short-circuited.

7. The linear actuator according to claim 1, wherein said first and second armature coils have windings housed entirely or partially in grooves in soft magnetic material, with worms of a thread or a plurality of interrupted ribs serving as grooves.

8. A high-voltage power switch, comprising a drive formed with a linear actuator according to claim 1 disposed in a gas chamber of the switch and configured to selectively open or close an electrical contact.

9. A high-voltage power switch, comprising at least one spring-loaded drive with a spring and a linear armature according to claim 1 for tensioning said spring and holding said spring in a tensioned state.

10. The linear actuator according to claim 1, further comprising a spring configured to be tensioned, and held in a tensioned state, by said armature of the linear actuator.

11. An electromagnetic linear actuator, comprising:

a stator at least partially made of soft magnetic material;

an armature at least partially made of soft magnetic material and being supported on said stator for movement relative to said stator along a longitudinal axis, said armature and said stator forming a gap therebetween along the longitudinal axis in an open position and lying against one another in a closed position with said gap closed;

wherein said stator is composed of a plurality of soft magnetic parts of which at least one is constructed as a tube in which said armature is guided;

an armature coil connected to said armature and configured to transmit a force acting on said armature coil to said armature; and a device for generating an excitation magnetic field guided at least partially by said stator and said armature and directed such that a force acts on said armature coil when current flows therethrough and the force is transmitted to said armature in order to close said gap;

said stator, said armature and the excitation magnetic field being configured such that a retaining force can take effect when said gap between said stator and said armature is closed;

at least one excitation coil fastened on said stator wound into a groove from outside onto a stator part constructed as a tube, which tube has such a thin wall in a vicinity of said winding that it can guide significantly less magnetic flux in the direction of the armature movement than said armature itself without saturating at least partially, and wherein said excitation coil wound onto said tube is surrounded with one or more other stator parts such that a closed magnetic circuit is formed with said tube whose magnetic path has a greater overall cross section than the minimal cross section of the wound tube, and that as a current grows in the excitation coil, in the absence of the armature at first the part of the tube wound with the excitation coil must therefore saturate.

12. The linear actuator according to claim 11, wherein said armature is wound with an armature coil associated with said excitation coil fastened on said stator, and a minimum armature cross section is in an area of the winding of said armature coil and is approximately equal to or smaller than a minimum cross section of said stator outside of said excitation coil.

* * * * *